United States Patent [19]

Pask

[11] 4,451,204

[45] May 29, 1984

[54] AEROFOIL BLADE MOUNTING

[75] Inventor: George Pask, Stanton-by-Bridge, England

[73] Assignee: Rolls-Royce Limited, London, England

[21] Appl. No.: 359,798

[22] Filed: Mar. 15, 1982

[30] Foreign Application Priority Data

Mar. 25, 1981 [GB] United Kingdom ..... 8109416

[51] Int. Cl.[3] ..... F01D 5/30

[52] U.S. Cl. ..... 416/215; 416/193 A; 416/248

[58] Field of Search ..... 416/193 A, 215, 216, 416/217, 219, 221, 248

[56] References Cited

U.S. PATENT DOCUMENTS

| | | | |
|---|---|---|---|
| 2,931,624 | 4/1960 | Hyde | 416/193 A |
| 3,923,420 | 12/1975 | Chifos . | |
| 3,972,645 | 8/1976 | Kasprow | 416/215 |
| 4,280,795 | 7/1981 | Trousdell | 416/193 A |

FOREIGN PATENT DOCUMENTS

| | | |
|---|---|---|
| 753229 | 7/1956 | United Kingdom . |
| 1274547 | 5/1972 | United Kingdom . |
| 1326122 | 8/1973 | United Kingdom . |

*Primary Examiner*—Charles T. Jordan
*Assistant Examiner*—Ted L. Parr
*Attorney, Agent, or Firm*—Cushman, Darby & Cushman

[57] ABSTRACT

A blade assembly for use in an axial flow compressor or turbine. The blade assembly includes a disc provided with a circumferential blade root retaining channel in its periphery and an annular array of aerofoil blades having roots located in the channel so that gaps are defined between adjacent roots. Each root is provided with two circumferentially extending sealing skirts which are arranged so that they cooperate with the blade roots to define an annular sealing surface which is in operation in sealing engagement with an annular portion of the internal surface of the root retaining channel.

4 Claims, 4 Drawing Figures

AEROFOIL BLADE MOUNTING

This invention relates to the mounting of aerofoil blades on a rotary disc and in particular to the mounting of the roots of aerofoil blades in a circumferential aerofoil blade root retaining channel provided in the disc periphery.

It is well known to provide a disc for an axial flow compressor or turbine with a circumferential channel in its periphery which is adapted to receive and retain the roots of a plurality of aerofoil blades. However such blade assembly configurations present problems in their assembly. More specifically the blade roots are usually of dovetail shape cross-section and the root channel in the disc periphery of corresponding cross-section shape. This dictates that an assembly slot must be provided at a suitable position in the root retaining channel in order that the blade roots may be fed through the slot and into the channel. Consequently if the blade root of each blade is of such a circumferential length that the roots of adjacent blades abut when assembly is complete, then the two abutting blade roots adjacent the slot will overlap the slot and therefore be partially unsupported. The usual method of solving this problem is to reduce the circumferential length of each blade root so that when assembled in the root retaining channel, circumferential gaps are defined between the roots of adjacent blades. The circumferential lengths of the blade roots are chosen so that when assembled, in the root retaining channel, none of the blade roots overlap the slot thereby ensuring that all blade roots are fully supported by the root retaining channel.

While reducing the circumferential length of each blade root ensures adequate support for all blade roots within the root-retaining channel, it unfortunately creates problems in achieving an effective gas seal between the blades and the disc. Thus gases passing in operation through the compressor or turbine tend to leak under the platforms of the blades and through the circumferential gaps between the blade roots.

It is an object of the present invention to provide a disc for an axial flow compressor or turbine having a plurality of aerofoil blades mounted in a circumferential channel in its periphery wherein improved gas sealing is achieved between the aerofoil blades and the disc.

According to the present invention blade assembly for use in an axial flow compressor or turbine comprises a disc having a circumferential aerofoil blade root retaining channel in its periphery, and an annular array of aerofoil blades having roots located in said root retaining channel, each of said aerofoil blade roots being circumferentially spaced apart from the roots of adjacent aerofoil blades so that circumferential gaps are defined between said roots, at least some of said aerofoil blades being provided with sealing means adapted to locate in but only partially occupy each of said thus defined circumferential gaps, said sealing means and said blade roots cooperating to define a substantially annular sealing surface which surface is in operation in sealing engagement with an annular portion of the internal surface of said root retaining channel.

Each of said sealing means is preferably integral with its associated aerofoil blade.

Each of said sealing means is preferably integral with the root of its associated aerofoil blade.

Said annular portion of the internal surface of said root-retaining channel with which said substantially annular sealing surface is in operation in sealing engagement may be on the upstream portion of said root retaining channel.

Each of said aerofoil blades is preferably provided with a platform which platform is interposed between the aerofoil portion and root of said aerofoil blade.

Each of said sealing means is preferably integral with the platform of its associated aerofoil blade.

Each of said aerofoil blades is preferably provided with two of said sealing means, one sealing means being positioned each side of the root of said aerofoil blade so that the adjacent sealing means of adjacent aerofoil blades abut each other.

Said sealing means may not circumferentially extend beyond the greatest circumferential extent of the platform of its associated aerofoil blade.

The invention will now be described, by way of example, with reference to the accompanying drawings in which.

Figure 1:
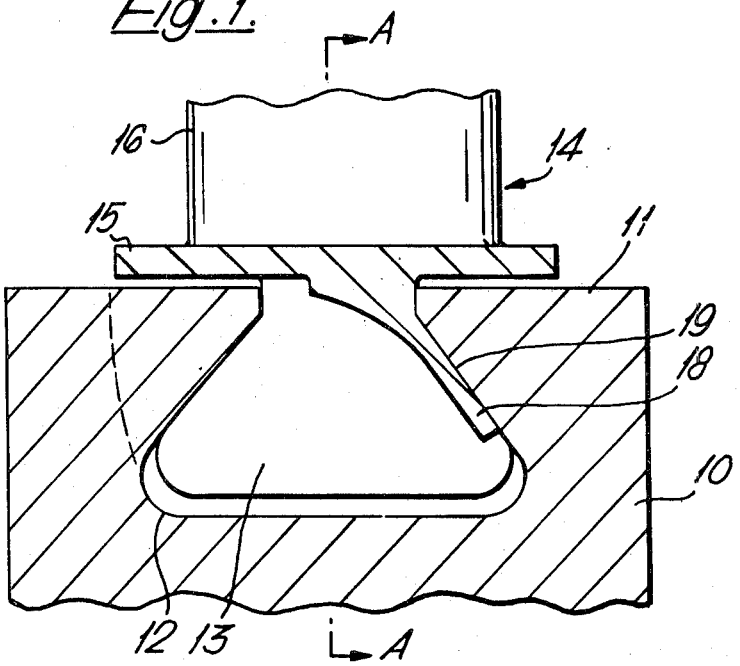
FIG. 1 is a sectioned side view of part of a blade assembly in accordance with the present invention.

With reference to FIG. 1, a disc 10 for use in an axial flow compressor or turbine of, for instance a gas turbine engine, is provided in its periphery 11 with a circumferential channel 12. The channel 12 is of dove-tail shape cross-section so as to receive and radially retain the similar cross-section shape roots 13 of a plurality of aerofoil blades 14. The aerofoil blades 14 are disposed in an annular array around the disc periphery 11 in the conventional manner of aerofoil blades of axial flow compressors and turbines.

Figure 2:
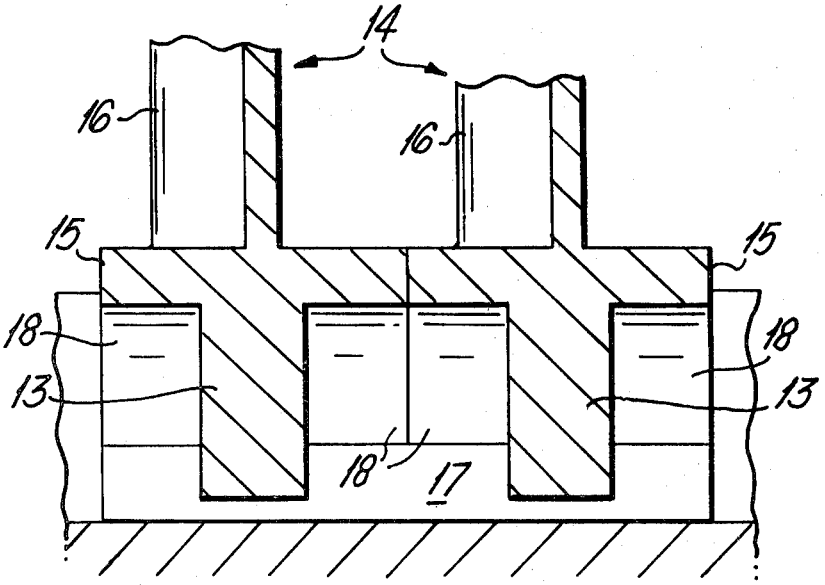
FIG. 2 is a view on section line A—A of FIG. 1.
Figure 3:
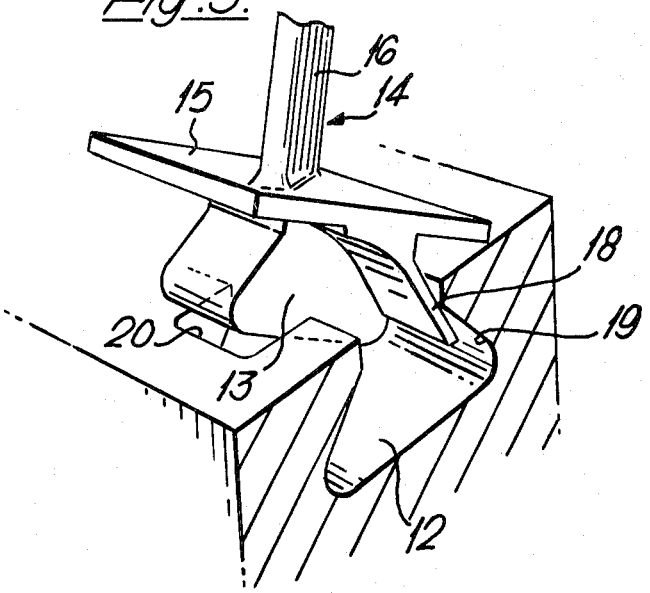
FIG. 3 is a view of a part of a blade assembly in accordance with the present invention showing how an aerofoil blade is loaded on to the disc.
Figure 4:
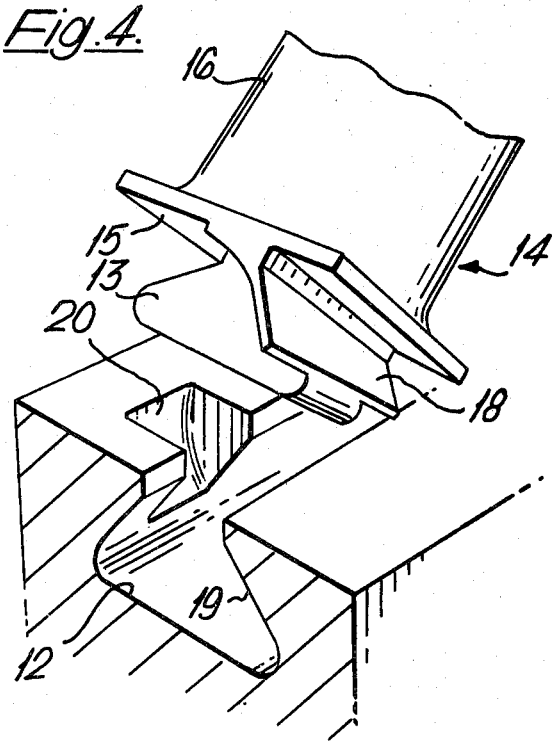
FIG. 4 is an exploded view of a blade assembly in accordance with the present invention.

Each of the aerofoil blades 14 has a platform 15 interposed between its aerofoil portion 16 and root 13. The platforms 15 of adjacent aerofoil blades 14 abut to define a radially inner boundary for gases passing in operation across the aerofoil portions 16. However the aerofoil blade roots 13 as can be seen in FIGS. 2 and 3 are circumferentially shorter than the platforms 15 so that circumferential gaps 17 are defined between the roots 13 of adjacent aerofoil blades 14.

Each root 13 is provided with two circumferentially extending sealing skirts 18 which extend into the gaps 17 so as to partially occupy them. The sealing skirts 18 are integral with the root 13 and platform 15 of their respective aerofoil blade 14. Each sealing skirt 18 does not circumferentially extend beyond the circumferential extent of the platform 15 of its associated aerofoil blade 14 so that the sealing skirts 18 of adjacent aerofoil blades 14 abut as can be seen in FIG. 2.

The roots 13 and sealing skirts 18 of the annular array of aerofoil blades 14 together define a substantially annular sealing surface which engages an annular portion 19 (FIGS. 1 and 3) on the upstream portion of the root retaining channel 12. Thus in operation when the disc 10 is rotated, centrifugal loadings ensure that the sealing skirts 18 and the roots 13 are urged into sealing engagement with the annular portion 19 of the channel 12. The seal so formed reduces or eliminates any tendency for gases passing across the aerofoil portions 16 to leak under the platforms 15 and by-pass the aerofoil portions 16.

It will be appreciated that although in the presently described embodiment of the present invention, the sealing skirts 18 do not circumferentially extend beyond the circumferential extents of the platforms 15 other alternative configurations are possible. Thus for instance, alternate sealing skirts 18 could circumferentially extend beyond the platforms 15 as long as the remaining sealing skirts 18 are correspondingly shorter so that adjacent sealing skirts 18 still abut.

The channel 12 in the disc 10 is provided with a slot 20 (FIG. 3) which permits loading of the aerofoil blade roots 13 into the blade root retaining channel 12. Thus the aerofoil blade 14 is positioned so that the root 13 and sealing skirts 18 rest against the rim of channel 12 in the manner shown in FIG. 3. The aerofoil blade 14 is then pivoted about the channel 12 rim so that the root 13 passes through the slot 20 and locates in the channel 12. The blade is then slid along the channel 12 to its desired location. When a complete set of blades 14 has been loaded into the channel 12, suitable conventional locking means (not shown) may then be used to lock them in position.

It will be appreciated that the present invention is applicable to both rotor and stator aerofoil blades and discs and the terms "blades" and "discs" should therefore be construed accordingly.

I claim:

1. A blade assembly for use in an axial flow compressor or turbine comprising:

a disc having a circumferential aerofoil blade root retaining channel extending about the periphery thereof, said root retaining channel including a bottom wall, an upstream wall defining an annular internal surface and a downstream wall defining an annular internal surface, said annular internal surface of said upstream wall and said annular internal surface of said downstream wall being spaced from and converging toward each other;

an annular array of aerofoil blades, each of said aerofoil blades including an aerofoil portion, a platform, and a root, said root of each of said annular array of aerofoil blades having an axial cross-section substantially identical to and being positioned in said root retaining channel, the root of each of said aerofoil blades being circumferentially spaced apart from the root of an adjacent one of said aerofoil blades to provide circumferential gaps therebetween in said root retaining channel, and sealing means integral with each root of each of said blades, said sealing means being located in said root retaining channel and only partially occupying each of said circumferential gaps, said sealing means and said blade roots cooperating to define a substantially annular sealing surface in abutting sealing engagement with at least the annular internal surface of said upstream wall of said root retaining channel.

2. A blade assembly as claimed in claim 1 in which said sealing means includes a sealing skirt extending circumferentially from each side of each root of said aerofoil blades, said sealing skirts of adjacent roots abutting each other.

3. A blade assembly as claimed in claim 2 in which said sealing means of said root of each of said blades has a circumferential extent substantially equal to a circumferential extent of said platform for the associated one of said blades.

4. A blade assembly as claimed in claim 3 in which said sealing means is also integral with the platform of the associated one of said aerofoil blades.

* * * * *